United States Patent [19]

Katzman et al.

[11] 4,161,081

[45] Jul. 17, 1979

[54] AMUSEMENT SET

[75] Inventors: Allison W. Katzman, Chicago; Palmer J. Schoenfield, Evanston; Burton C. Meyer, Downers Grove, all of Ill.

[73] Assignee: Marvin Glass & Associates, Chicago, Ill.

[21] Appl. No.: 876,401

[22] Filed: Feb. 10, 1978

[51] Int. Cl.[2] ..... A63H 33/00

[52] U.S. Cl. ..... 46/11; 46/12

[58] Field of Search ..... 46/11, 12, 13, 14, 19, 46/116, 20, 21; 35/16

[56] References Cited

U.S. PATENT DOCUMENTS

| | | | |
|---|---|---|---|
| 3,182,420 | 5/1965 | Bender | 46/12 |
| 3,363,360 | 1/1968 | Ryan | 46/12 |
| 3,483,653 | 12/1969 | Genin | 46/12 |
| 3,849,930 | 11/1974 | Stubbmann | 46/19 X |
| 4,030,235 | 6/1977 | Terzian et al. | 46/11 |
| 4,060,929 | 12/1977 | Meyer et al. | 46/11 |

*Primary Examiner*—Louis G. Mancene
*Assistant Examiner*—Mickey Yu
*Attorney, Agent, or Firm*—Mason, Kolehmainen, Rathburn & Wyss

[57] ABSTRACT

An amusement set (for use particularly by children) comprises a carrying case including a pair of mating, hollow housing members pivotally connected along one edge to open and close around a peripheral seam line of each member. Each of the housing members includes internal wall structure defining a plurality of rooms at different levels and a hollow elevator shaft is mounted in coaxial alignment with the axis of pivotal interconnection between the housing members to extend between the different room levels. Openings are provided in the elevator shaft walls at different levels and an elevator is provided for manual movement up and down within the shaft between the different room levels. The amusement set includes a plurality of toy figurines which represent fictional play characters such as bugs and/or insects. The upper walls of the housing members are formed to resemble the surface of the ground and a plurality of openings are provided for access to the rooms within the housing members from the top. The underground rooms provide play spaces for the bug or insect-like characters. At the upper end, the elevator shaft is provided with a sewer-like grate which opens and closes access to the shaft from ground level and several of the openings provided in the upper walls of the housing members provide a holding space for hollow enclosures which are insertable therein for holding the play characters. These hollow enclosures are shaped and decorated to resemble growing vegetables or the like in a garden and a novel handle for the carrying case also shaped and decorated to resemble growing plant-life is provided.

23 Claims, 6 Drawing Figures

AMUSEMENT SET

BACKGROUND OF THE INVENTION

A. Field of the Invention

This invention relates to amusement devices for children and more particularly to an amusement set which comprises a carrying case for holding a plurality of toy figures which represent fictional play characters such as might be developed in the theme of a radio or television show or other media produced for children. The carrying case is opened for play and includes a pair of mating hollow housing members which are hingedly connected together along an axis surrounded by a hollow elevator shaft extending between rooms in the housing members at different levels. The toy figurines are fashioned to resemble bug or insect-like characters and are movable in and around the rooms of the opened housing members and elevator shaft through the various openings.

B. Description of the Prior Art

Children's amusement sets and the like have been well received by the public and a variety of different themes have been developed. As far as known, there has not been a comprehensive amusement set having a hollow carrying case formed by a pair of mating housing members with the upper walls of the members being fashioned to resemble the surface of the earth or ground and with internal rooms therebelow fashioned as rooms beneath the earth's surface. Toy figurines or play characters are styled to resemble bugs or insects and are movable around the rooms and into and out of an elevator shaft provided around the axis of pivotal interconnection between the housing members. A bucket-like elevator is mounted in the elevator shaft and at the upper end, the shaft is opened and closed by a sewer-like grate. During play, the toy figurines are moved up and down in the shaft in the elevator bucket between different room levels and are manipulated as desired around the premises.

SUMMARY OF THE INVENTION

The present invention comprises a new and improved amusement set particularly designed for use by young children. The amusement set includes a hollow carrying case which is formed by a pair of hollow, mating housing members pivotally interconnected along one edge to open and close along a peripheral seam line around each housing member. Each of the housing members includes an internal wall structure which defines a plurality of rooms at different levels below the upper surface of the housing walls which is styled to resemble the surface of the ground or earth. A hollow elevator shaft is mounted in coaxial alignment with the axis of pivotal interconnection between the housing members and the hollow shaft extends between various rooms at different levels with openings in the shaft wall so that toy figurines or play characters resembling bugs or insects can be moved around between the different rooms and different levels below the surface of the earth. The elevator bucket is manually movable up and down the shaft between the different levels to carry the play characters and the upper end of the elevator shaft is opened and closed with a sewer-like grate which is pivotally attached to the upper wall of one housing member.

A plurality of toy figurines styled to represent bug or insect-like fictional play characters such as may be developed in a television theme or the like are movable about the rooms of the housing members and up and down within the elevator shaft in the elevator bucket. In one feature of the amusement set, the ground or earth surface of the housing members is formed with various openings therein so that the play characters may be passed down into the various underground rooms or into the elevator shaft. In several of the openings, hollow enclosures styled in the form of growing vegetables (such as a carrot) are removably insertable and these enclosures are dimensioned to be large enough to hold a play character completely enclosed therein.

BRIEF DESCRIPTION OF THE DRAWINGS

For a better understanding of the present invention, reference should be had to the following detailed description taken in conjunction with the drawings, in which.

DESCRIPTION OF THE PREFERRED EMBODIMENT

Figure 1:
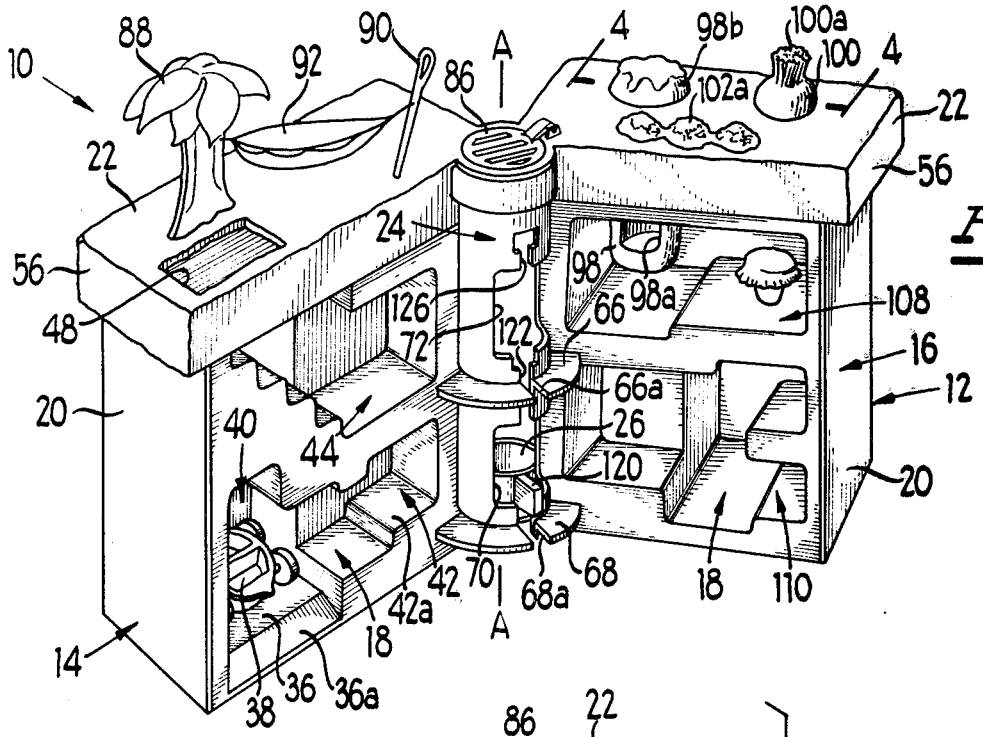
FIG. 1 is a perspective view of an amusement set in an open condition ready for play.
Figure 2:
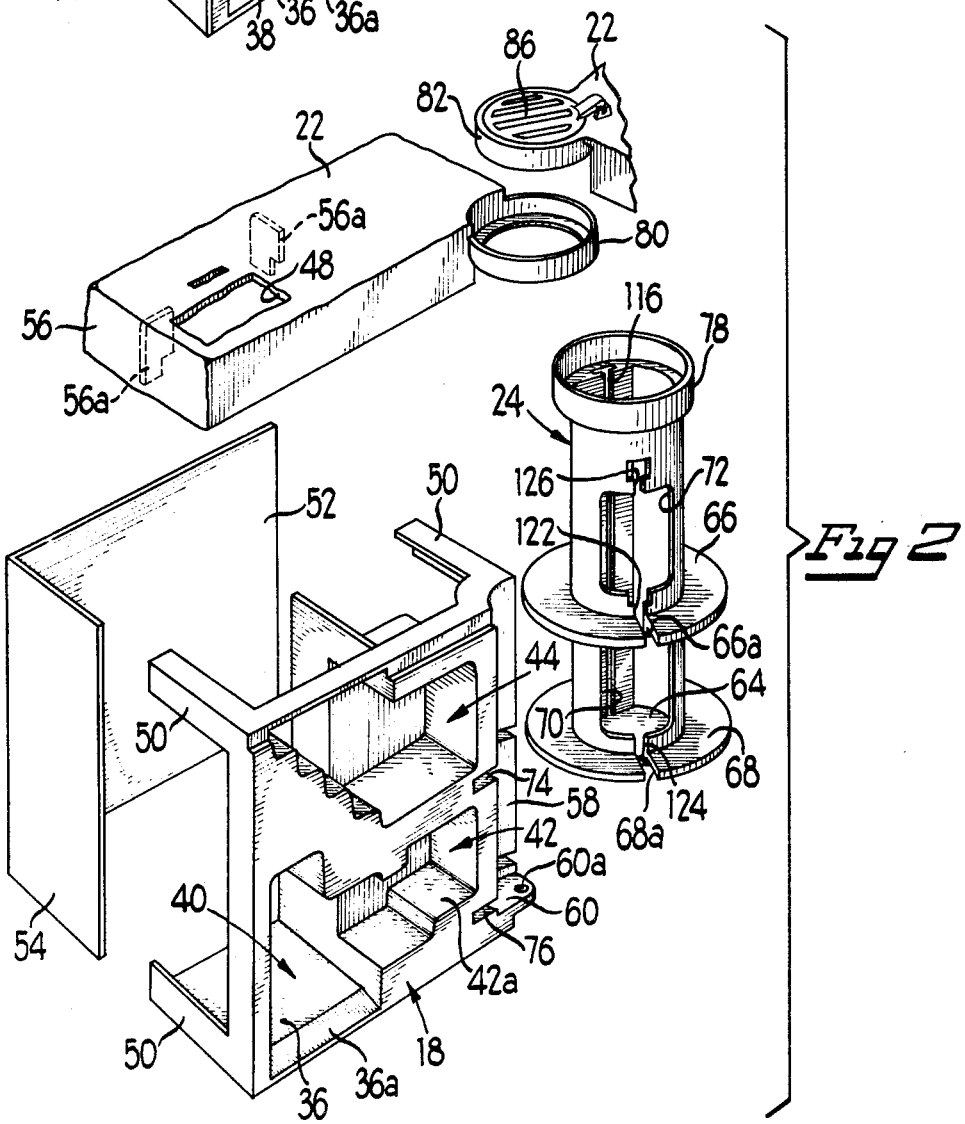
FIG. 2 is an exploded, perspective view of a portion of a housing member and elevator shaft of the amusement set of FIG. 1.
Figures 3, 4, 5, 6:
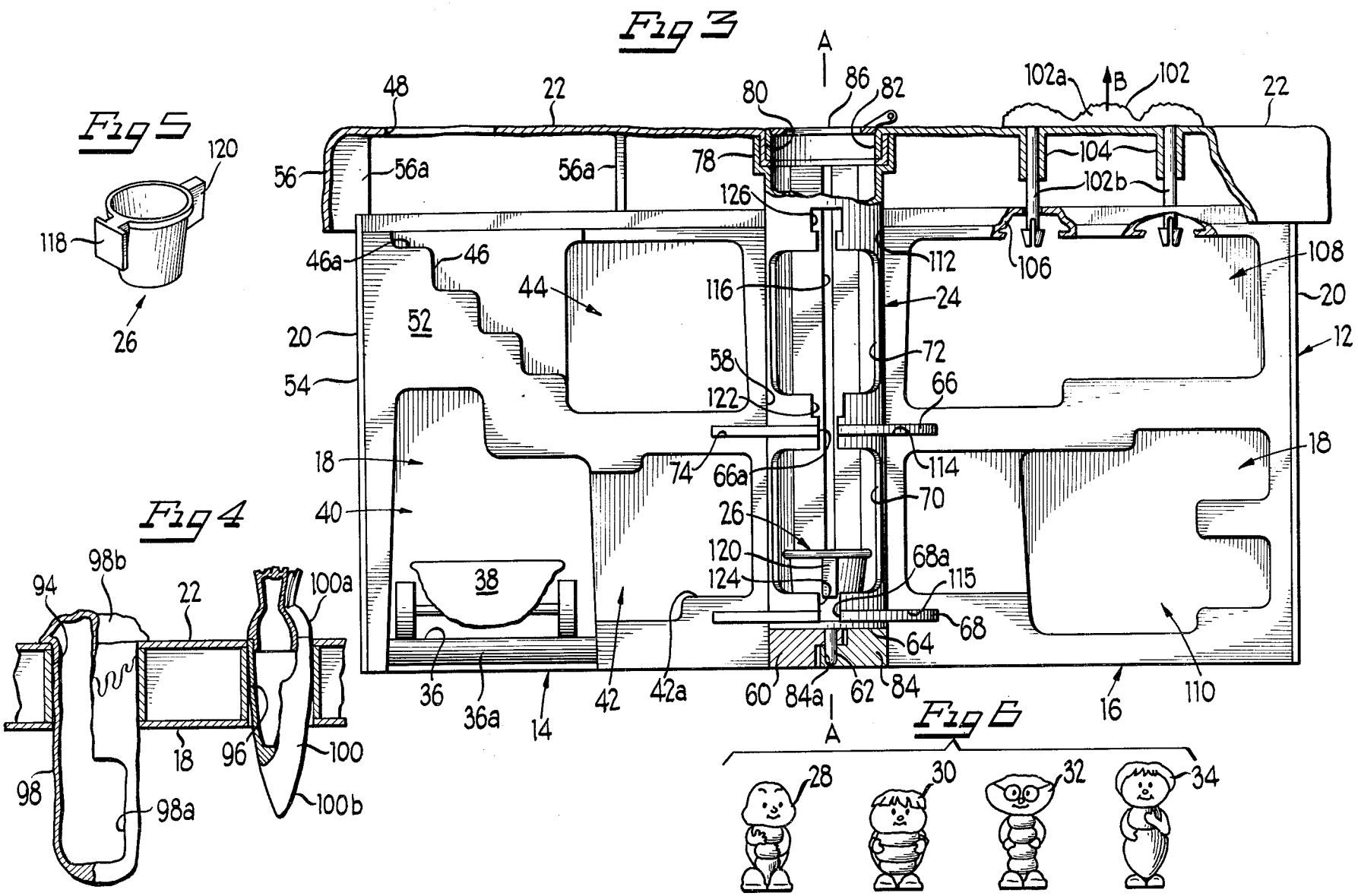
FIG. 3 is an elevational view of the hollow housings of the amusement set looking at the fully open sides thereof.
FIG. 4 is an enlarged, fragmentary sectional view taken substantially along lines 4—4 of FIG. 1.
FIG. 5 is a perspective view of an elevator bucket of the amusement set.
FIG. 6 is a front, elevational view of several bug or insect-like toy figurines or play characters in accordance with the present invention.

Referring now more particularly to the drawings, a new and improved amusement set constructed in accordance with the features of the present invention is illustrated and is referred to generally in FIGS. 1 and 3 by the reference numeral 10. The amusement set is particularly adapted for use by children and includes a hollow carrying case 12 formed by a pair of mating, hollow half members 14 and 16 which are pivotally connected together for movement between an open position (FIG. 1) ready for play and a closed position (not shown) wherein the halves meet and close together around a peripheral mating seam line to form a hollow carrying case for containing a plurality of playing pieces of the amusement set as will be described. Preferably, the housing members 14 and 16 are formed of molded plastic material and as shown in FIG. 2, each housing member is constructed of an inner wall forming structure 18, a generally L-shaped outer side wall member 20 and a flanged upper cap or top wall member 22. As indicated, the inner wall structure 18, outer side walls 20 and top wall 22 of the respective left hand and right hand housing members 14 and 16 are not identical and will be described in some detail hereinafter.

The hollow housing members are pivotally interconnected about a vertical pivot axis A—A (FIGS. 1 and 3), and a generally cylindrical hollow elevator shaft 24 is coaxially aligned with the pivot axis to extend between upper and lower room levels in the housing members. As illustrated in FIGS. 1, 3 and 5, a bucket or cup shaped elevator 26 is provided for movement up and down within the elevator shaft between different levels of the housing members in order to carry, one at a time, the toy figurines 28, 30, 32 and 34, which as shown in FIG. 6 are styled, decorated and shaped to represent bugs or insect-like fictional play characters in accordance with the theme of the amusement set. These play characters are dimensioned to fit easily within the elevator bucket 26 and are adapted to be manually moved about the premises of the open carrying case into and out of the various rooms at different levels.

The inner structure 18 and the top wall portion 22 of the respective left and right hand housing members of the carrying case are different in design and for the left hand housing member 14, the inner structure 18 includes a bottom wall, garage floor portion 36 having a sloping ramp-like section 36*a* in order to accommodate a wheeled toy vehicle 38 having one or more compartments therein dimensioned to carry one or more of the toy play characters 28, 30, 32 or 34. The bottom wall 36 is the floor of a garage 40 for holding the vehicle and adjacent thereto, the structure 18 is formed with a lower level room 42 having a stepped floor 42*a* as illustrated. The structure 18 is also provided with an upper level room 44 and a staircase 46 extends upwardly from the left hand edge of the floor of the upper room 44, with a top step 46*a* spaced directly below a rectangular opening 48 formed in the top wall structure 22. The opening 48 is dimensioned to permit the toy figurines 28, 30, 32 etc. to easily pass through the top wall structure and move down the staircase 46 into the upper level room 44.

The inner structure 18 of the left hand housing member includes a plurality of corner elements or horizontally extending legs 50 which project toward an opposite outer side wall portion 52 and an outer end wall 54 is secured to the left hand side portions of the left hand legs. The top wall structure 22 is provided with a continuous down turned peripheral edge flange 56 which extends downwardly below the upper edges of the internal structure 18 and the side wall structure 20 as best shown in FIG. 3. The top wall 22 is provided with a plurality of internal mounting ribs 56*a* having notched lower edges which rest upon the upper edges of the internal wall structure 18 and the outer wall 20 as shown.

Along the right hand vertical edge portion, the internal structure 18 is formed with a cylindrically shaped wall surface 58 recessed inwardly in order to accommodate the generally cylindrical elevator shaft 24. At the lower end of the recess 58, there is provided an integral hinge member 60 having an opening 60*a* defined therein for receiving a downwardly depending hinge pin 62 formed on the lower end wall 64 of the elevator shaft. The elevator shaft 24 is provided with a pair of upper and lower, annular, circular flanges 66 and 68, respectively, and these flanges are positioned at approximately the same levels as the floors of the upper room 44 and the lower room 42 formed by the internal structure 18 of the left hand housing member 14.

The circular flanges 66 and 68 are wide enough to provide a walkway for the toy figurines 28, 30, 32 and 34 etc. which may be moved around over the flanges or placed at rest thereon. Between the upper and lower flanges, the elevator shaft 24 is formed with an enlarged opening 70 of generally rectangular shape and above the upper flange 66 a similar opening 72 is provided. These openings permit the elevator bucket 26 and/or the figurines 28, 30, 32 and 34 to be moved into and out of the elevator shaft during play. The internal structure 18 of the left hand housing member 14 is formed with a pair of radial, horizontal slots 74 and 76 for receiving the circular flanges 66 and 68, respectively, as the elevator shaft 24 and left hand housing member 14 are pivoted about the pivot axis A—A.

A pivotal bearing interconnection with the upper end of the elevator shaft 24 is provided between upper end portions of the respective left and right hand, hollow housing halves 14 and 16 of the carrying case 12. For this purpose, the left hand housing top wall 22 is formed with an open cylindrical projection 80 at an inner right hand upper corner adapted to seat within an enlarged flange portion 78 on the upper end of the elevator shaft 24. Similarly, the top wall 22 of the right hand housing member 16 is provided with a cylindrical flange 82 adapted to seat within the flange 80 of the left hand housing member. As shown best in FIG. 3, the flanges 78, 80 and 82 of the elevator shaft and the respective left and right hand housing members nest or seat within each other to provide a cylindrical, pivotal bearing connection between these members. The right hand housing member 16 is provided with a lower hinge member 84 having a hinge pin opening 84*a* therein adapted to receive the downwardly projecting hinge pin 62 of the elevator shaft and cooperate with the hinge portion 60 on the housing member 14. From the foregoing it will be seen that the elevator shaft 24 provides a pivotal hinged connection or journal shaft between the two housing half members 14 and 16 so that the carrying case 12 may open and close freely as previously described.

The cylindrical flange portion 82 on the right hand housing member 12 includes an upper wall having a circular opening therein in order to accommodate a closure member 86 which is pivotally attached to a bracket on the upper wall 22 of the right hand housing member. The closure 86 is formed with a plurality of slots therein and resembles a sewer grate which may be opened and closed to permit access to the upper end of the shaft for the elevator bucket 26 and toy figurines 28, 30 etc. The upper surface of the top wall 22 of both the left and right hand housing members is formed and decorated to resemble the slightly uneven and irregular surface of the earth, and the rooms within the internal structures 18 of the respective housing members are designed and decorated to resemble underground rooms for the insect or bug-like play characters. To add more interest, on the upper wall 22 of the left hand housing member 14 there is provided a bean plant 88 and a needle 90 with a hammock 92 resembling an open pea pod interconnected between the bean plant and needle to support one or more toy figurine play characters. Referring now to the right hand housing member 12, the top wall 22 thereof is formed with a pair of spaced apart circular holes or wells 94 and 96 (FIG. 4) and a hollow enclosure 98 representing a growing vegetable such as a potato is removably insertable into the well 94 as best illustrated in FIG. 4. The potato 98 includes a large opening 98*a* in the wall adjacent a lower level therein in order that one of the toy characters may be moved in and out of the enclosure during play. The potato includes an upper cap portion 98*b* decorated and designed to resemble the top or above ground portion of the growing vegetable. The hole or well 96 provides a resting spot for a hollow member 100 insertable therein and decorated to resemble a growing vegetable such as a carrot. The carrot 100 is formed in two different parts including a removable upper or top portion 100*a* and a lower bottom portion 100*b*. The hollow interior of the carrot is large enough to contain one of the toy figurine characters so that when a player removes the carrot top he may be surprised to find a bug or insect-like play character therein.

In accordance with another novel feature of the present invention, the right hand housing member 16 is provided with a unique handle 102 having an upper bight portion 102*a* shaped and decorated to resemble growing plants or ground vegetation. The handle includes a pair of downwardly depending legs 102*b* (FIG. 3) which are inserted into integral hollow sleeves formed on the underside of the top wall 22. At the lower end, the legs 102*b* are formed with frustoconical deflectable, split-end portions which are used for securing the handle to the housing member when the handle is moved upwardly (arrow "B") to be grasped for carrying the closed case 12. The lower end portions of the handle legs extend downwardly into annular recesses 106 formed in the ceiling or upper wall of an upper level room 108 formed in the interior structure 18. The upper room 108 is provided with a stepped lower wall or floor which is adjacent the level of the floor of the upper room 44 in the opposite housing member 14. The internal structure 18 of the right hand housing member 12 is also provided with a lower level room 110 of irregular shape having a stepped lower wall or floor with a portion adjacent and generally at the same level as the floor 42*a* of the room 42 in the opposite housing member.

The internal structure of the right hand housing member is provided with an elongated vertical, cylindrically shaped recess 112 similar to the recess 58 on the opposite housing member for accommodating the elevator shaft 24. A pair of horizontal recesses 115 and 116 radiate outwardly at different levels in the structure 18 for accommodating the flanges 66 and 68, respectively, of the elevator shaft. In order to guide the elevator bucket 26 during vertical travel up and down the hollow elevator shaft 24, the shaft is provided with a T-shaped guide way or slot 116 in a chordal flatted wall portion on the back wall of the shaft. The slot 116 is dimensioned to accommodate a T-shaped, radially extending key 118 (FIG. 5) formed on the elevator bucket at the rearward side. Opposite the T-shaped key, the bucket is formed with a vertically disposed handle or arm 120 for conveniently grasping the elevator bucket to lower and lift the same. When the T-shaped key 118 on the bucket 26 is slideably engaged in the vertical slot 116, of the elevator shaft 24, the handle 120 is within the interior of the elevator shaft 24. However, if it is desired to insert or remove the elevator bucket through the side wall openings 70 and 72 in the shaft rather than through the upper end of the shaft which is normally closed by the sewer grate 86, the bucket must be removed through the upper end of the shaft before insertion into the side openings 70 and 72. When inserted from the side, the key is not engaged in the slot of the shaft and the handle may serve as a stop to support the bucket in one of several positions or levels in the shaft. For this purpose, the upper flange 66 is formed with a radial slot 66*a* to permit passage of the handle as the bucket is moved through different levels in the shaft. The lower flange 68 includes a similar slot 68*a* and the upper and lower openings 72 and 70 in the wall of the shaft are in communication with a T-shaped interconnecting slot 122 which provides a rest for the elevator bucket handle. An aligned slot 124 is provided on the lower edge of the lower opening 70 in order to similarly accommodate the elevator bucket handle and at the upper end of the large opening 72, the elevator shaft is formed with another T-shaped slot 126.

When the T-shaped key 118 on the elevator bucket is not engaged within the vertical T-shaped guide way 116 on the wall of the elevator shaft, the bucket is adapted to be moved freely into and out of the hollow shaft through the side wall openings 70 and 72 and the notched edges of the slots 122, 124 and 126 in the shaft wall provide means for supporting the bucket at different levels by the handle 120 which extends outwardly through the slots as illustrated in FIG. 1. When the bucket is keyed to the shaft guide 116, the handle is within the interior of the elevator shaft and is used only for moving the elevator bucket up and down in the shaft rather than radially outwardly through the side wall openings 70 and 72.

From the foregoing it will be seen that the amusement set of the present invention provides fantasy and fun for children of relatively young ages. The toy figurine, play characters 28, 30, 32 and 34 in the style of bugs or insects are readily moved around and in the rooms, the housing members 14 and 16, which members are designed to provide underground rooms beneath upper walls 22 which are representative of the surface of the earth. Many hours of enjoyment at play are provided for children by the amusement set 10 of the present invention.

Although the present invention has been described with reference to a single illustrated embodiment thereof, it should be understood that numerous other modifications and embodiments can be devised by those skilled in the art that will fall within the spirit and scope of the principles of this invention.

What is claimed as new and desired to be secured by Letters Patent of the United States is:

1. An amusement set (for use particularly by children), comprising:

a carrying case including a pair of mating hollow housing members pivotally connected along one edge to open and close along a peripheral seam line around each member, each of said hollow housing members including internal wall means therein defining a plurality of rooms at different levels when said housings are rested on a bottom wall in an open position;

a hollow, elevator shaft in coaxial alignment with the axis of pivotal interconnection between said housing members extending between said different levels, said shaft having openings at said different levels exposed between said housing members when in an open condition; and an elevator manually movable in said shaft between said different levels.

2. The amusement set of claim 1 including interlocking key means interconnecting said shaft and said elevator for guiding the elevator during movement between said different levels.

3. The amusement set of claim 1 wherein said elevator includes handle means projecting outwardly of said openings for moving said elevator up and down in said shaft.

4. The amusement set of claim 3 wherein at least one of said openings is formed with a shoulder adjacent a lower level for supporting said handle means when said elevator is positioned at a level adjacent said one opening.

5. The amusement set of claim 2 wherein said key means includes an elongated key slot formed in said shaft opposite said openings and a key on said elevator slideably engaged in said slot.

6. The amusement set of claim 5 wherein said key slot is of T-shaped transverse cross-section and said key is of a similar cross-section to fit in said slot for sliding movement between said different levels.

7. The amusement set of claim 1 wherein said elevator shaft is generally cylindrical and at least a portion thereof serves as a pivot bearing between said housing members.

8. The amusement set of claim 7 wherein said elevator shaft is formed with at least one generally circular, flange extending radially outwardly of said pivot axis at a level adjacent one of said levels of said housing member.

9. The amusement set of claim 8 wherein said circular flange is formed with a radial slot permitting passage of said elevator between said different levels of said housing members.

10. The amusement set of claim 7 wherein said housing members are recessed adjacent said pivotal interconnection for rotatively receiving adjacent portions of said elevator shaft.

11. The amusement set of claim 8 wherein said housing members are formed with slots for slideably receiving said circular flange on said elevator shaft.

12. The amusement set of claim 1 wherein said elevator shaft is provided with a bottom wall adjacent a lower end for supporting said elevator in said shaft at a lower level adjacent said housing members.

13. The amusement set of claim 12 wherein said elevator shaft is open adjacent an upper end and including gate means pivotally mounted on one of said housing members for opening and closing said upper end of said shaft.

14. The amusement set of claim 13 wherein said gate is formed with slots therein resembling a sewer grating.

15. The amusement set of claim 1 including one or more toy figurines decorated to represent play characters and dimensioned to fit within said elevator and pass through said shaft openings for manipulation within and around the rooms of said housing members.

16. The amusement set of claim 15 wherein said toy figurines are designed to represent bugs.

17. The amusement set of claim 15 wherein said housing members are formed with openings in wall portions thereof dimensioned to pass said toy figurines.

18. The amusement set of claim 17 wherein said openings are formed in upper wall portions of said housing members designed to represent the surface of the ground.

19. The amusement set of claim 18 including one or more containers for holding a toy figurine therein and adapted to be removably mounted in one of said openings in said upper wall portion.

20. The amusement set of claim 19 wherein at least one of said containers is designed to represent a growing vegetable.

21. The amusement set of claim 20 wherein one of said containers includes a top portion manually removable from a separate bottom portion.

22. The amusement set of claim 20 wherein one of said containers is formed with an opening in a side wall portion thereof spaced below a closed upper end and dimensioned to pass said toy figurines.

23. The amusement set of claim 1 including a U-shaped handle mounted on at least one of said housing members for carrying said set, said handle having a pair of legs slideably mounted in a wall portion of said housing member for movement between an upper carrying position and a lower position wherein a bight portion is adjacent an upper wall portion of said housing member, said bight portion shaped to resemble vegetation when said handle is in said lower position.

* * * * *